US008646299B2

(12) United States Patent
Sloth

(10) Patent No.: US 8,646,299 B2
(45) Date of Patent: Feb. 11, 2014

(54) PIN TUMBLER LOCK SYSTEM AND A KEY PIN FOR SUCH SYSTEM

(75) Inventor: Poul Sloth, Veksø (DK)

(73) Assignee: Poul Sloth ApS, Vekso (DK)

( * ) Notice: Subject to any disclaimer, the term of this patent is extended or adjusted under 35 U.S.C. 154(b) by 63 days.

(21) Appl. No.: 13/255,259

(22) PCT Filed: Mar. 10, 2010

(86) PCT No.: PCT/EP2010/053016

§ 371 (c)(1),
(2), (4) Date: Nov. 28, 2011

(87) PCT Pub. No.: WO2010/103032

PCT Pub. Date: Sep. 16, 2010

(65) Prior Publication Data

US 2012/0090364 A1 Apr. 19, 2012

(30) Foreign Application Priority Data

Mar. 13, 2009 (EP) ..... 09155136

(51) Int. Cl.
*E05B 27/00* (2006.01)

(52) U.S. Cl.
USPC ..... 70/493; 70/358; 70/368; 70/378; 70/384

(58) Field of Classification Search
USPC ..... 70/340–343, 368, 376–378, 382–385, 70/392, 491–496
See application file for complete search history.

(56) References Cited

U.S. PATENT DOCUMENTS

| | | | | |
|---|---|---|---|---|
| 2,194,469 | A | 3/1940 | Fremon | |
| 2,263,713 | A * | 11/1941 | Folger | 70/143 |
| 4,372,139 | A * | 2/1983 | Laake | 70/383 |
| 5,233,850 | A | 8/1993 | Schroeder | |
| 5,325,690 | A * | 7/1994 | Adler et al. | 70/383 |
| 2003/0154752 | A1 * | 8/2003 | Price | 70/358 |

FOREIGN PATENT DOCUMENTS

| | | |
|---|---|---|
| JP | 2007 247336 A | 9/2007 |
| WO | 2004/079134 A1 | 9/2004 |

* cited by examiner

*Primary Examiner* — Christopher Boswell
*Assistant Examiner* — David R Hare
(74) *Attorney, Agent, or Firm* — Gifford, Krass, Sprinkle, Anderson & Citkowski, P.C.

(57) ABSTRACT

The present invention concerns a pin tumbler lock system having a housing, a plug, and easy accessible driver pins, key pins and springs. The system is configured so that the lengths of the key pins are adjustable from the outside without taking the lock apart.

8 Claims, 3 Drawing Sheets

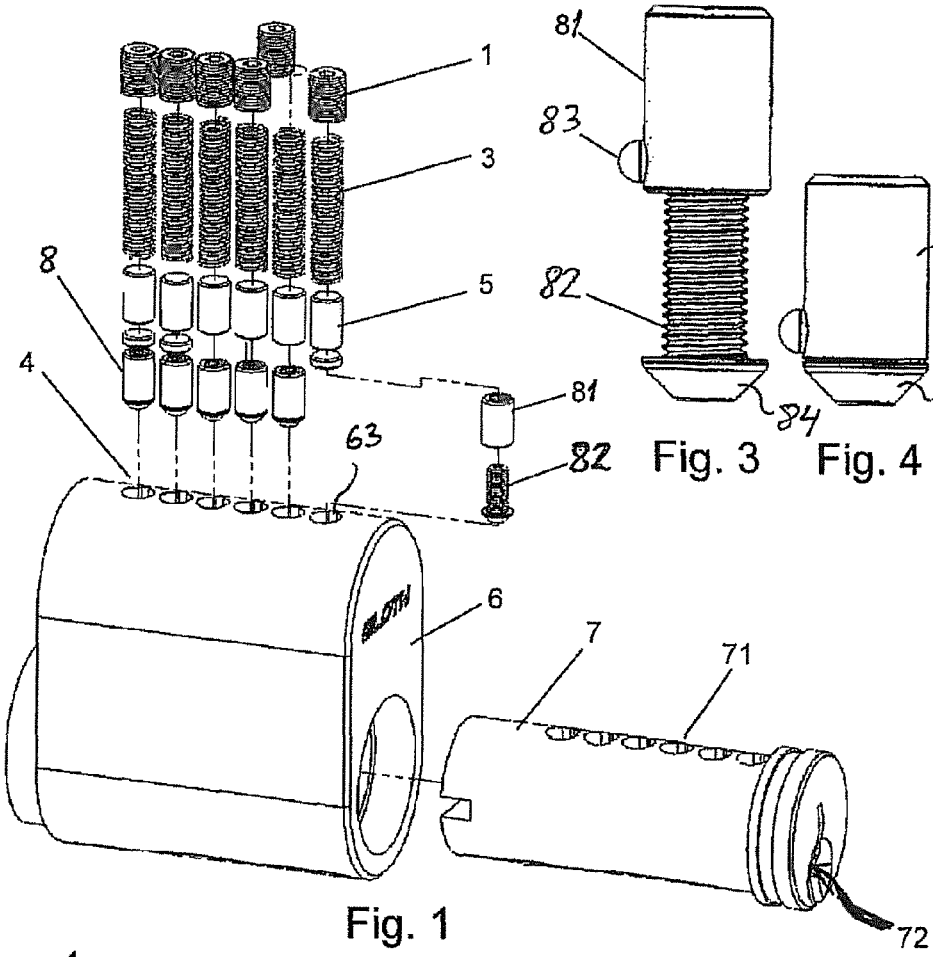
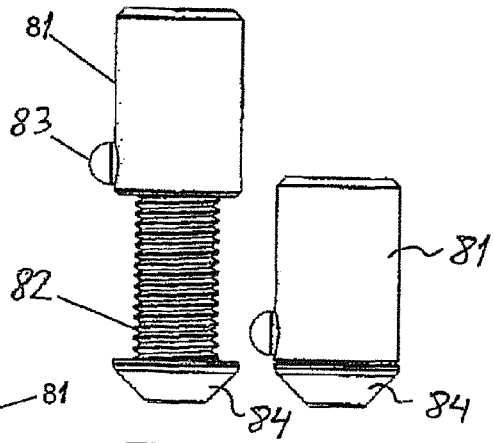
Fig. 3 Fig. 4
Fig. 1
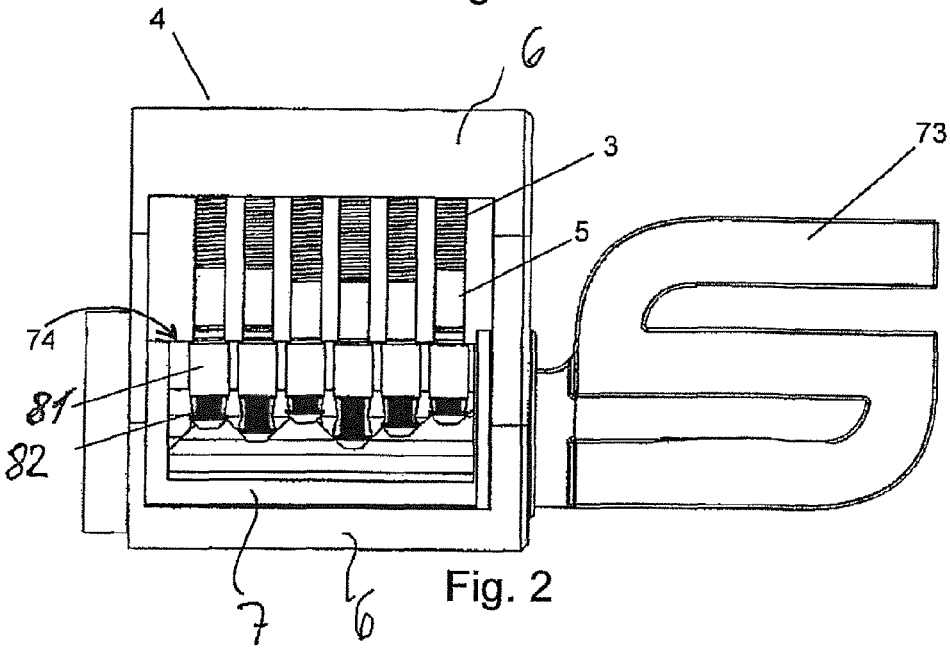
Fig. 2

PIN TUMBLER LOCK SYSTEM AND A KEY PIN FOR SUCH SYSTEM

CROSS-REFERENCE TO RELATED APPLICATIONS

This application is the U.S. National Phase of PCT/EP2010/053016 filed Mar. 10, 2010, which claims priority of European Patent Application 09155136.6 filed Mar. 13, 2009.

FIELD OF INVENTION

The present invention relates to a pin tumbler lock system for a lock, said system comprising a housing having at least one first housing channel; a plug rotatably mounted in the housing, said plug having at least one opening for a key and having at least one first plug channel that aligns with the first housing channel along a shear line between the plug and the housing; at least tumbler pin set comprising a driver pin, a key pin, and a spring member arranged in the first housing channel for extension into the first plug channel, such that the plug is in a locked position, wherein rotation of the plug is disallowed, when the driver pin extends into the first plug channel and the plug is in a unlocked position, wherein rotation of the plug is allowed, when the gap between the key pin and the driver pin is aligned with the shear line, which can be realized by insertion of a proper key.

BACKGROUND OF INVENTION

Pin tumbler lock systems have been in use at least since one type was patented by inventor Linus Yale, Sr. in 1848. The basic principles are still used today, as for instance can be seen in U.S. Pat. No. 7,181,941 B2 or WO 2008/103515. In particular, the lock may be opened when the gap between tumbler pins, called key pins and driver pins, are arranged along a shear line and conversely the lock is closed when the driver pins extend across the shear line. The basic principles are still used today, however, it is often time consuming for locksmiths to change the combination of a pin tumbler lock that is broken, has been compromised or when there is another reason to change the lock combination. Tumbler pins that can be adjusted are known from JP 2007 247 336, and WO 2004/079134 A1.

In addition, a pin tumbler lock, having adjustable tumbler pins, is disclosed in U.S. Pat. No. 2,194,469. The lengths of the tumbler pins in this reference are changed by being telescoped and, in addition, the tumbler pins comprise guiding ears arranged in associated channels which serve to confine the tumbler pins.

SUMMARY OF INVENTION

It is an object of the invention to provide a pin tumbler lock system with easy access to springs and tumbler pins and/or easy access to code, decode or recode the lock combination without compromising the security of the lock.

The object is achieved by a lock system of the initially mentioned kind, wherein at least one key pin comprises a first key pin member with at least one internally threaded portion; a second key pin member with an externally threaded portion for engagement with the first key pin member, and a rotation prevention means for preventing the key pin from rotating when mounted in the housing channel and/or plug channel. Preferably, the first key pin member is prevented from rotating by the rotation prevention means.

By using a rotation prevention means the first key pin member and the second key pin member may be adapted to be fixed in position relative to each other such that the length of the key pin is adjustable.

The pin tumbler lock system according to the invention may be used with a door lock or a pad lock or other types of locks.

By having adjustable key pins, a locksmith may easily change the lock combination in a non-destructive way. The adjustable key pins are reusable and the lock combination may be coded, recoded or decoded in an authorised manner without having to take the lock according to the invention apart. In addition, the same type of key pin can be used for all the key pins.

In the preferred embodiment of the pin tumbler lock system, there is provided a plurality of key pins and, preferably, the number of key pins is equal to the number of driver pins.

In an embodiment of the pin tumbler lock system, the rotation prevention means comprises a side protrusion protruding from the key pin and a side groove arranged in the housing channel and/or plug channel for receiving the side protrusion of the key pin.

The side protrusion and the side groove is thereby useful in preventing the first key pin member from rotating in the housing channel and/or plug channel when the length of the key pin is adjusted, by rotating the second key pin member with a suitable tool. The second key pin member is preferably free to rotate and the first key pin member is preferably prevented from rotating due to the side protrusion. It is preferred that the second key pin member does not have any rotation preventing side protrusions or rotation preventing guiding ears, which is the case of the lock disclosed in U.S. Pat. No. 2,194,469.

In another embodiment, the pin tumbler lock system may comprise a third member. In this embodiment, the rotation prevention means may comprise a first side groove arranged in the key pin, a second side groove arranged in the housing channel and/or plug channel, and a third member adapted to engage with the first side groove and the second side groove.

In a preferred embodiment of the pin tumbler lock system, at least one first housing channel extends from the shear line through the housing to an aperture on the outer surface of the housing, whereby at least one driver pin and/or at least one key pin and/or at least one spring member may easily be taken apart from the housing for coding, recoding, decoding and/or adjustment, such as adjustment of the length of the key pin. According to the invention, coding, recoding or decoding may be performed without taking the tumbler pins and springs apart from the housing. This is advantageous since quick coding, recoding or decoding of the lock combination can be achieved. In addition, the lock may be re-used with new keys, when the length of one or more key pins is changed.

In an embodiment, when the housing channels extend to apertures on the outer surface of the housing, the tumbler pins and springs may easily be taken out of the lock for adjustment. This process is less cumbersome and less time consuming compared to a lock having housing channels only accessible from one open end at the interface of the plug and the housing.

In a second preferred embodiment of the pin tumbler lock system, at least one first housing channel has an internal threaded portion for engagement with a stopping member having an external threaded portion and an engagement means, such as a groove for engagement with a tool and by which engagement the stopping member may be taken apart from the housing. In this preferred embodiment, at least one stopping member may be adapted to be fixed in different positions lengthwise in at least one housing channel.

The stopping member is adapted to be fixed in different positions lengthwise in at least one housing channel. This is advantageous because the springs may be compressed more or less depending on the position of the stopping member. By having differently compressed springs, the force acting on different tumbler pins is different as well, making unlocking by lock picking more difficult. Another approach is to establish the same spring force irrespective of the key/pin code, whereby the lock cannot be compromised by measuring of the length of the pins for unauthorized decoding the lock. In addition, the tumbler pins and the springs in the lock may be identical.

In another preferred embodiment of the pin tumbler lock system, at least one first key pin member and/or at least one second key pin member and/or at least one driver pin and/or at least one spring have/has an engagement means for engagement with a tool. By engagement with a tool, the length of the key pin may be adjusted more precisely and in addition the key pins, driver pins and springs may be adjusted without removing them from plug channels and housing channels. Further, by engagement with a tool, the lock combination may be coded, recoded or decoded without removing tumbler pins and springs from the plug and housing channels and/or key pin wafers may be added or removed. By engagement with a proper tool, the first key pin members, second key pin members, driver pins or springs may be taken out for repair or replacement.

In a related preferred embodiment, the second key pin member is provided with an engagement means, such as a hexagonal cavity, a groove or the like for engagement with a tool. The second pin member is preferably provided with a distal pin head and the engagement means, such as a hexagonal cavity, is preferably provided with the distal pin head. The engagement means is for instance provided in the pin head, which is adapted for engagement with the key, when it is inserted in the lock. The engagement means may thereby have an opening that points towards the inserted key and/or towards an additional plug channel. Such an engagement means is advantageous for adjusting the length of the tumbler pin while the tumbler pin is still inside the cylinder lock, i.e. without taking the lock apart. The engagement means of the second key pin member may, for instance, easily be engaged with a tool through an additional plug channel. The invention has furthermore advantages in that the length of the key pin member may be adjusted, by rotating the second pin member by a suitable tool, in a precise manner so that the key pin member is extended or shorted by a length that corresponds to turning the second key pin member a predetermined rotational amount, such as a quarter turn, a half turn, a full turn, a number of full turns or combinations of the mentioned amounts of rotation. Further, in relation to the driver pins, it is preferred that at least one of the driver pins is solid, for instance shaped as a solid cylinder.

In another embodiment of the pin tumbler lock system, at least one additional plug channel is provided for engagement with the first key pin member and/or the second key pin member by at least one tool whereby at least the length of the key pin may be adjusted.

In another embodiment of the pin tumbler lock system, at least one second plug channel is aligned with at least one associated second housing channel, which extends from an aperture on the inner surface of the housing to an aperture on the outer surface of the housing for engagement of the second key pin member with a tool. Moreover, the second plug channel is aligned with a common bore axis with a first plug channel. By having these additional second plug channels aligned with associated second housing channels in the tumbler housing, the key pins may be adjusted with a tool while they are in place in the lock. For instance while the key pins are inside the lock, the length of the key pins may be adjusted such that the lock combination may be coded, recoded or decoded.

In particular, in a preferred embodiment of the lock system, the length of the key pins may be changed with a tool while they are in place in the lock with no key inserted in the lock. Insertion of a key is thereby not necessary for coding or recoding the key pins. In addition, the lock system is preferably adapted so that it may easily be incorporated with existing lock systems. For instance, the key(s) of an existing lock system may be retained for continued use while the existing lock is exchanged, e.g. upgraded, with a new lock according to the invention.

In another preferred embodiment of the pin tumbler lock system, the first key pin member comprises stopping means, such as nylon insert lock means. This principle is known from locknuts, in particular elastic stop nuts and nyloc nuts. This is advantageous because the second key pin member may be substantially fixed in position relative to the first key pin member when stopping means is provided.

In another aspect of the invention there is provided a key pin for a pin tumbler lock system comprising a first key pin member with at least one internally threaded portion, a second key pin member with an externally threaded portion for engagement with the first key pin member, and a rotation prevention means for preventing the key pin from rotating when mounted in the housing channel and/or plug channel. In one embodiment of the key pin, the first key pin member comprises stopping means, such as nylon insert lock means.

BRIEF DESCRIPTION OF THE DRAWINGS

The invention is disclosed in more detail with reference to the accompanying drawings, in which:

FIG. 1 is a perspective view of the pin tumbler lock system according to a preferred embodiment of the invention, FIG. 2 is a cross section side view of the pin tumbler lock system in FIG. 1, FIG. 3 is an enlarged side view of a key pin in an extended state, FIG. 4 is an enlarged side view of a key pin in a retracted state.

DETAILED DESCRIPTION OF THE DRAWINGS

Figure 5:
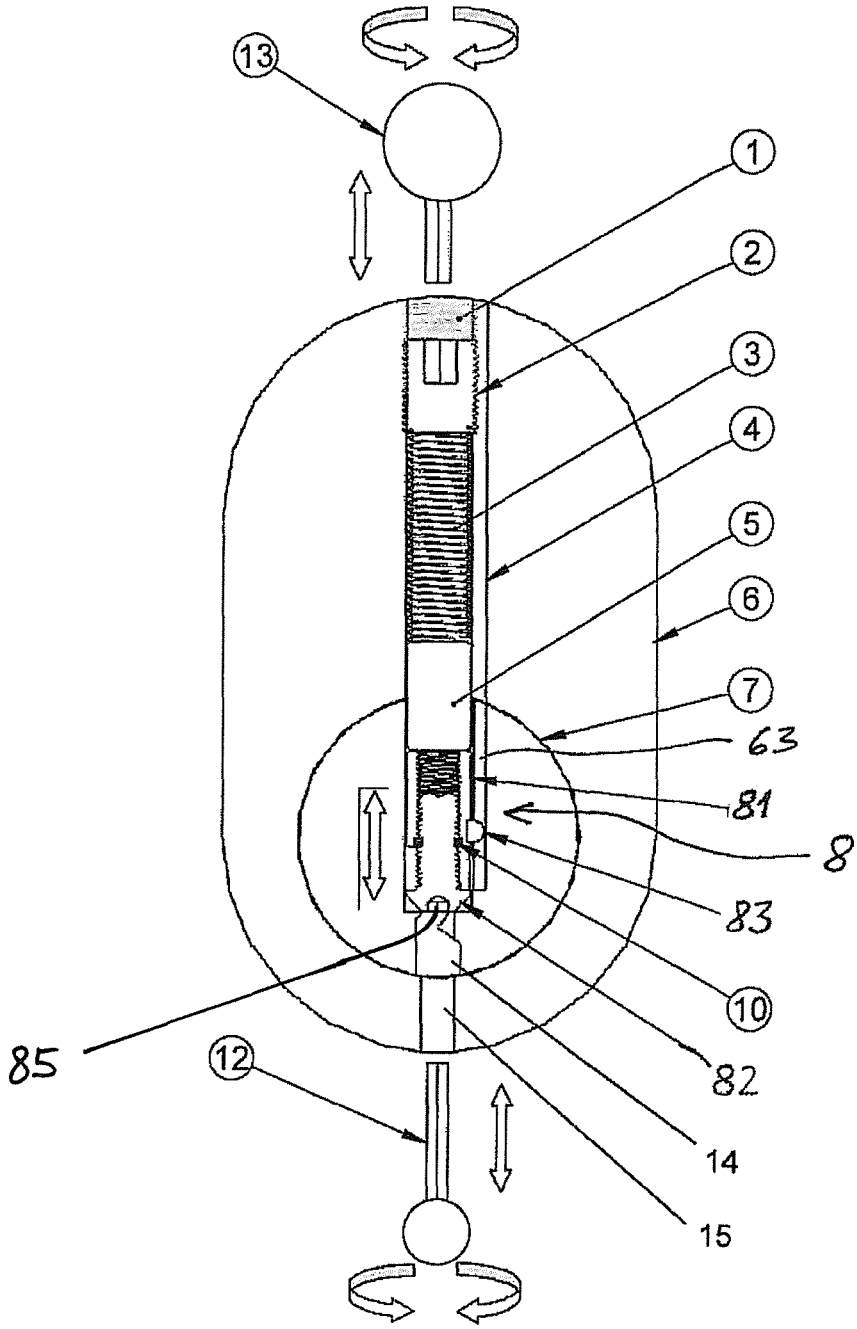
FIG. 5 is a cross section front view of the pin tumbler lock system in FIG. 1.

A skilled person would appreciate that for clarity purposes; in different figures, same numerals are used to indicate the same component in the apparatus.

With reference to the figures, the pin tumbler lock system comprises a housing 6 having a number of housing channels 4 and a rotatably mounted plug 7 with a number of plug channels 71, preferably equal in number to the number of housing channels 4.

The plug has an opening 72 for a key 73. Springs 3 and tumbler pin sets, i.e. driver pins 5 and key pins 8 are arranged in the housing channels 4, such that the plug 7 is in a locked position, wherein rotation of the plug 7 is disallowed, when the driver pins 5 extends into the plug channels 71. By insertion of a proper key, as shown in FIG. 2, the plug 7 acquire an unlocked position whereby rotation of the plug 7 is allowed. In the unlocked position the transitions between the key pins 8 and the driver pins 5 are aligned with the shear line 74 which is the interface line between the plug and the housing.

In a preferred embodiment of the pin tumbler lock system, the key pins 8 comprise a first key pin member 81 with an internally threaded portion, a second key pin member 82 with an externally threaded portion for engagement with the internally threaded portion of the first key pin member 81, whereby the length of the key pin 8 is adjustable (compare for instance FIGS. 3 and 4). The length of the key pin may be set or deduced according to a reference point, such as a starting point. In one embodiment, this reference point corresponds a position of minimal or maximal length of the key pin, where the second key pin member has reached an extremum, see FIG. 4 for an example. The second key pin member 82 is provided with a distal pin head 84 which is adapted for engagement with the key 73 when it is inserted in the lock. The distal pin head 84 has an engagement means 85, cf. FIG. 5, such as a hexagonal cavity, a groove or the like for engagement with a tool 12. The first key pin member 81 may also be provided with a side protrusion 83 which, when the key pin member 81 is inserted into one of the housing channels 4 and plug channels 71, cooperates with the side groove 63 provided along this housing channel 4 and plug channel to prevent the first key pin member 81 from rotating relative to the second key pin member 82. Hereby, it is possible to adjust the length of the key pin 8.

Figure 6:
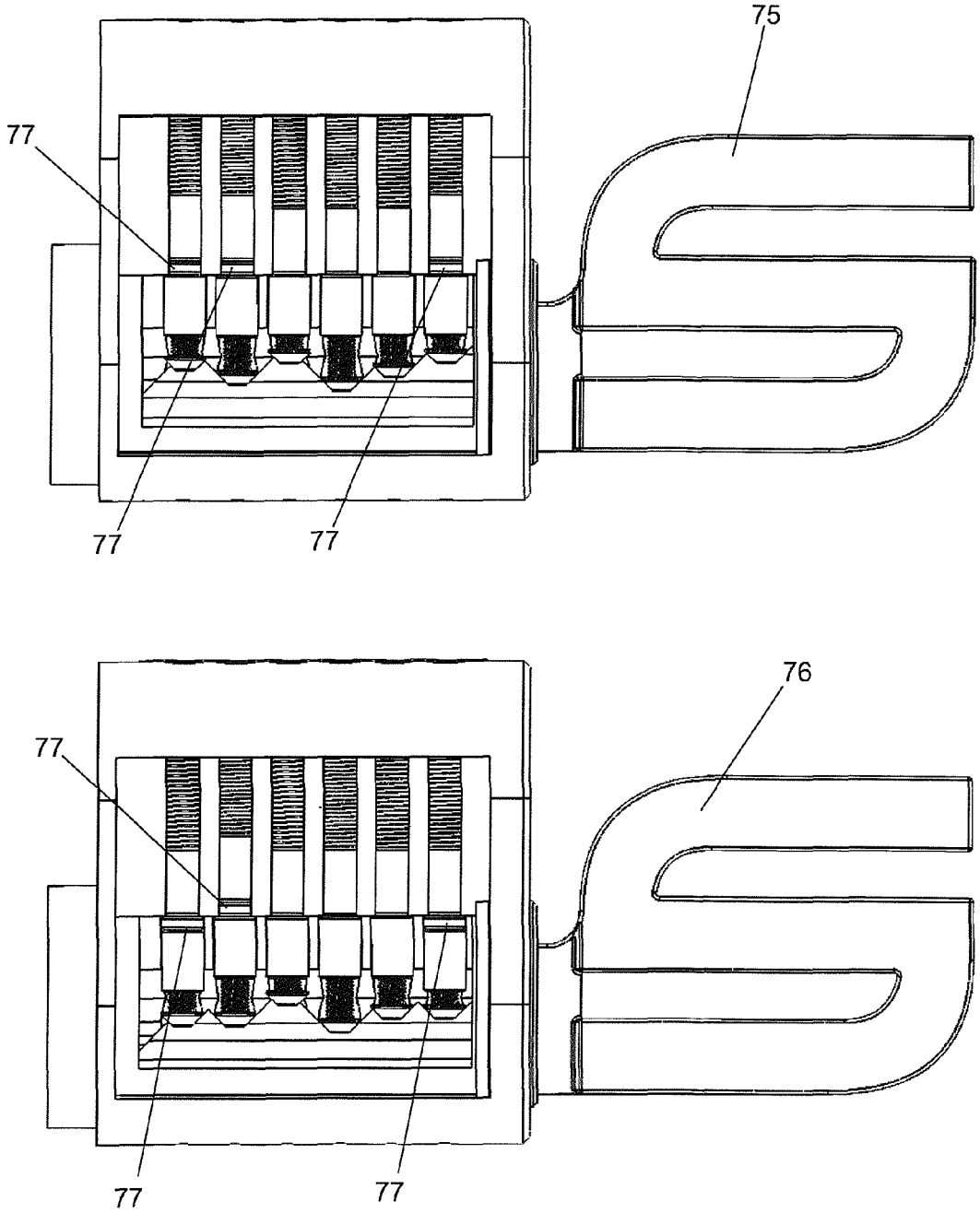
FIG. 6 is a cross section side view of the invention according to a master key system.

In one embodiment of the of the pin tumbler lock system according to the invention, there is provided a master key system, see FIG. 6. The master key system comprises at least a master key 75, at least an under key 76, and a plurality of master key system wafers 77. According to the invention, it is possible to code, recode or decode the lock combination in a master key system without taking the master key system wafers 77 apart from the lock.

In a preferred embodiment of the pin tumbler lock system according to the invention, the housing channels 4 have an internal threaded portion 2 for engagement with a stopping member 1 having an external threaded portion and a rotation engagement means, such as a groove or another tool-fitting cavity, for engagement with a mounting tool 13, such that the stopping member 1 may be mounted when the key pin assembly is fitted into the housing channel 4 of the housing 6.

In an embodiment of the pin tumbler lock system according to the invention, the first key pin member 8 comprises a stopping member 10, such as nylon insert lock means.

In an embodiment of the pin tumbler lock system according to the invention, the second key pin members 82 have an engagement means 85, such as a hexagonal cavity, a groove or the like for engagement with a tool 12. The plug 7 may comprise second plug channels 14 aligned with associated second housing channels 15 in the housing 6 and aligned with the housing channels 4. In this embodiment, the second key pin members 82 may be engaged by the tool 12, whereby the length of the key pins 8 may be adjusted since the first key pin member 81 is prevented from rotating due to the side protrusion 83 cooperating with the side groove 63.

In a preferred embodiment, the diameter of the key pins 8 and/or driver pins 5 is greater than the diameter of the second plug channels 14 and/or associated second housing channels 15 (compare with FIG. 5), whereby the key pins and/or driver pins cannot fall out or cause an adverse locking when the plug is turned.

While specific and preferred embodiments of the invention have been shown and described in detail above to illustrate the inventive principles, it will be understood that variants to these embodiments may be provided without departing from the scope of the invention as set forth in the accompanying claims.

The invention claimed is:

1. A pin tumbler lock system for a lock, said system comprising a housing having at least one first housing channel and at least one second housing channel, the housing having an inner surface and an outer surface, the second housing channel extending from an aperture in the inner surface to an aperture in the outer surface;

a plug rotatably mounted in the housing, said plug having at least one opening for a key and having at least one first plug channel that aligns with the first housing channel along a shear line between the plug and the housing, the plug further having at least one second plug channel;

a tumbler pin set comprising a driver pin, a key pin, and a spring member arranged in the first housing channel for extension into the first plug channel, such that the plug is in a locked position, wherein rotation of the plug is disallowed, when the driver pin extends into the first plug channel, and the plug is in a unlocked position, wherein rotation of the plug is allowed, when the gap between the key pin and the driver pin is aligned with the shear line, which can be realized by insertion of a proper key;

wherein said key pin comprises a first key pin member with at least one internally threaded portion, a second key pin member with an externally threaded portion for engagement with the first key pin member, and a rotation prevention means for preventing the key pin from rotating when mounted in the housing channel and/or plug channel, said rotation prevention means comprising a side protrusion protruding from the key pin and a side groove arranged in the housing channel and/or plug channel for receiving the side protrusion of the key pin; and the second plug channel being aligned with the second housing channel such that a one of the key pin members is engagable by a tool through the aperture on the outer surface of the housing.

2. A pin tumbler lock system according to claim 1, wherein said at least one first housing channel extends from the shear line through the housing to an aperture on the outer surface of the housing, so that said driver pin and/or key pin and/or spring member may easily be taken apart from the housing for repair or adjustment.

3. A pin tumbler lock system according to claim 1, wherein said at least one first housing channel has an internal threaded portion for engagement with a stopping member having an external threaded portion and an engagement means operable for engagement with a tool and by which engagement the stopping member may be taken apart from the housing.

4. A pin tumbler lock system according to claim 3, wherein said stopping member is configured and operable so as to be fixable in different positions lengthwise in at least one housing channel.

5. A pin tumbler lock system according to claim 1, wherein the second plug channel is aligned with a common axis with a first plug channel.

6. A pin tumbler lock system according to claim 1, wherein the system comprises a plurality of key pins.

7. A pin tumbler lock system according to claim 6, wherein each of the key pins comprises a first key pin member with at least one internally threaded portion, a second key pin member with an externally threaded portion for engagement with the first key pin member, and a side protrusion on the first key pin member adapted for engagement with a cooperating side groove provided in a housing channel of the tumbler lock, such that the first key pin member and the second key pin member are configured and operable to be fixed in position relative to each other and such that the length of the key pin is adjustable.

8. A pin tumbler lock system according to claim 1, wherein at least one first key pin member further includes stopping means.

* * * * *